United States Patent [19]

Lisiecki

[11] 4,397,394

[45] Aug. 9, 1983

[54] LIQUID CONTAINER WITH STRAW OPENING MEANS

[75] Inventor: Robert E. Lisiecki, Orchard Lake, Mich.

[73] Assignee: Ex-Cell-O Corporation, Troy, Mich.

[21] Appl. No.: 399,658

[22] Filed: Jul. 19, 1982

[51] Int. Cl.[3] ..... B65D 5/72; B65D 33/36

[52] U.S. Cl. ..... 206/608; 229/7 S

[58] Field of Search ..... 229/7 S, 7 SC, 17 R; 206/607, 608, 612, 615, 628, 630

[56] References Cited

U.S. PATENT DOCUMENTS

| | | | |
|---|---|---|---|
| 3,399,820 | 9/1968 | Foster | 206/628 |
| 3,549,079 | 12/1970 | Northrup | 229/17 R |
| 3,770,185 | 11/1973 | Reeves | 229/17 G |
| 3,853,261 | 12/1974 | Moore | 206/612 |
| 4,142,635 | 3/1979 | Capo | 229/17 R |
| 4,194,677 | 3/1980 | Wysocki | 229/17 R |
| 4,244,474 | 1/1981 | Wise | 229/17 G |
| 4,318,479 | 3/1982 | Lisiecki | 229/7 S |

*Primary Examiner*—Herbert F. Ross

*Attorney, Agent, or Firm*—John P. Moran

[57] ABSTRACT

The drawings and description disclose a liquid carrying paperboard carton having straw opening means formed in a side wall panel thereof. The straw opening means includes a first tear strip formed on the side seam-supported edge of one side panel by spaced laterally-extending die cuts formed all the way through the paperboard layer, and extending from a side edge across a portion of the width of the underlying panel to a vertical score line for forming a flexible hinge. A second tear strip is formed on the underlying side seam by die cuts formed through the thermoplastic coating only, directly beneath the first tear strip. An arcuate cut is formed on the panel adjacent the side seam through the coating thereon so as to interconnect the inner ends of the second tear strip. The arcuate tab formed by the latter cut breaks away from its panel when the carton is formed, and serves as a starter tab for lifting the first and second tear strips, whereupon the tear strips may be peeled back past a notch or edge of the underlying side seam to accommodate the insertion of a straw therein.

6 Claims, 6 Drawing Figures

LIQUID CONTAINER WITH STRAW OPENING MEANS

TECHNICAL FIELD

This invention relates generally to liquid carrying paperboard cartons or containers, and, more particularly, to such containers provided with improved means for readily forming an opening for inserting a straw therein.

It is essential that liquid carrying paperboard containers reach the consumer in a convenient, safe and sanitary condition, and also be capable of retaining such sanitary condition while being handled, and the contents thereof consumed, by school children and adults alike. Where straw opening means are provided on such containers, such means must also measure up to the convenience, safety and sanitation requirements.

BACKGROUND ART

U.S. Pat. No. 3,770,185 provides for a straw opening means wherein parallel score lines are cut from one side and a circular score line is cut from the opposite side of one vertical wall above the gable, each to a depth of from 40 to 75 percent of the wall thickness. Such score lines form a tear strip extending from the upper vertical edge, along the width of the vertical wall and onto one gable. A "thumb notch" is formed on the uppermost edge of the other vertical wall to facilitate the opening process. Once the tear strip is torn away along the lines defined by the parallel score lines, a plug of material encompassed by the circular score line remains intact with the tear strip to expose a hole for receiving a straw.

U.S. Pat. No. 4,244,474 provides for a straw opening means wherein spaced apart score lines are formed to extend laterally from the edge of a conventional gable top roof panel interconnecting-side seam flap, to a depth of at least halfway through the paperboard, forming a tear strip such that when the tear strip is peeled or torn away past the free edge of the side seam panel, a weakened area is exposed which may be penetrated by the pressing of a straw thereagainst. In one embodiment, an extended tab is formed by notching the side seam panel of an adjacent carton blank in the cut-off operation from a paperboard roll.

U.S. Pat. No. 4,318,479 provides for a straw opening means wherein a tab and tear strip are formed on the panel overlying the side seam panel bearing an arcuate notch comparable in shape to the tab.

DISCLOSURE OF INVENTION

An object of the invention is to provide a liquid carrying container including improved means for readily forming a sanitary straw opening therein without having to open a pouring spout.

Another object of the invention is to provide a liquid carrying, paperboard container including an improved straw opening means associated with a side wall thereof, rather than with a conventional gable top.

A further object of the invention is to provide a liquid proof, thermoplastic coated paperboard container including improved overlapping tear strips formed integral with the first side panel and the underlying narrow fifth panel or side seam flap, and adjacent the respective free edges thereof.

Still another object of the invention is to provide a plastic coated, flat top type container embodying straw opening means including a first tear strip formed on the side seam-supported edge of one side panel by spaced laterally-extending die cuts formed all the way through the paperboard layer, and extending from a side edge of the panel, laterally across a portion of the width of the underlying side seam to a vertical score line formed intermediate the inner ends of the die cuts, thus defining a flexible hinge between the ends of the die cuts when the tear strip is peeled back from the edge of the panel, and a second tear strip formed on the underlying side seam by spaced laterally-extending die cuts formed through the plastic coating film only, directly beneath the first tear strip, with an arcuate cut formed on the panel adjacent the side seam so as to interconnect the inner ends of the second tear strip.

A still further object of the invention is to provide a container with such straw opening means and, additionally, including a notched or arcuate shaped opening formed along the free edge of the side seam flap at a location intermediate the die cuts thereon so as to form an opening adaptable to having a straw inserted therethrough once the two tear strips are peeled back beyond the flexible hinge.

These and other objects and advantages of the invention will be apparent when reference is made to the following description and accompanying drawings.

BEST MODE FOR CARRYING OUT THE INVENTION

Figure 1:
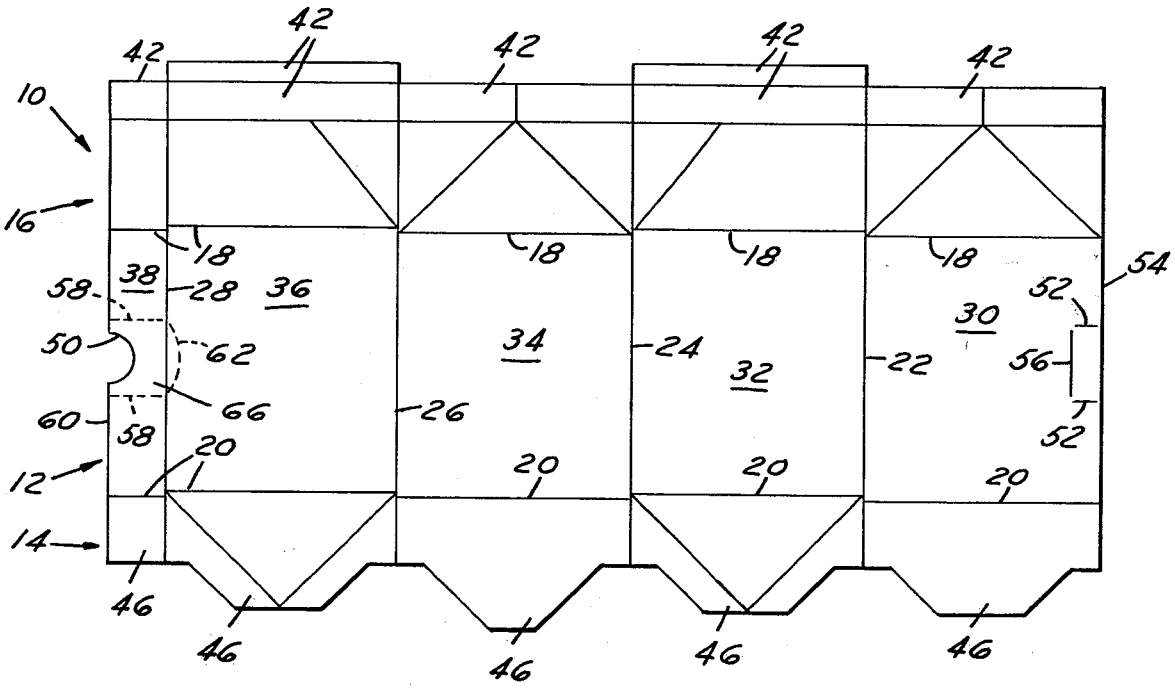
FIG. 1 is a layout view of the inside surface of a blank from which a container embodying the invention may be erected.

Referring now to the drawings in greater detail, FIG. 1 illustrates a paperboard blank 10 formed from kraft paperboard. The paperboard is covered on both sides with a suitable thermoplastic material, such as polyethylene, in order to render a container formed from the paperboard fluid-tight and capable of holding liquids such as milk and juices.

The container blank 10 includes a body portion 12 which, in the present instance, is substantially square in cross section. At its base the body portion 12 is provided with a suitable bottom end closure portion 14. The upper end of the body portion 12 is provided with a suitable flat top end closure portion 16.

The flat blank 10 is formed of high-grade paperboard coated with outer and inner layers of polyethylene thermoplastic material. By means of an appropriate pattern of score lines, the blank 10 is divided into a plurality of panels and sections which are utilized for the walls of a container and the top and bottom closure parts when the container is erected therefrom. The central or body portion 12 of the blank 10 becomes the body of the container and is defined by spaced apart transverse score lines 18 and 20, running in substantially parallel relation across the face of the blank. Intersecting the lines 18 and 20 at spaced intervals therealong are a series of perpendicular score lines 22, 24, 26 and 28, which define, in the central and major area of the blank, side or wall panels 30, 32, 34 and 36, together with a fractional side or wall panel or side seam flap 38, sometimes referred to as the fifth panel. When a container 40 (FIG. 2) is erected, the side seam flap 38 is adhesively secured in overlying relation with the side panel 30.

It should be noted that the transverse score lines 18 and 20 are not continuous but are formed in staggered portions interrupted by the perpendicular score lines 22, 24, 26 and 28. The purpose of this staggered scoring is to accommodate the thickness of the paper as the paper is bent along the score lines when the container is erected and thus prevent crowding of the paper at the various junctions of the score lines. This not only enhances the strength and appearance of the finished container but facilitates its erection and closure by automatic machinery.

Integral with the upper ends of the side panels, but separated therefrom by the transverse score line 18, are a plurality of panel extensions 42 which are foldable into a flat top configuration. This may be accomplished in any known manner. As one example, it may be formed initially as a conventional gable top, and then folded into a flat top closure 44 (FIG. 2), as illustrated and described in U.S. Pat. No. 3,869,078, incorporated herein by reference, but forming no part of the present invention.

Figure 2:
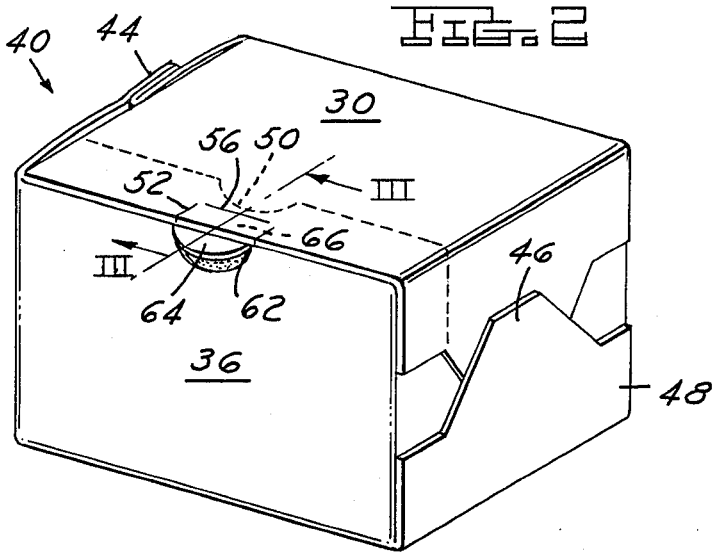
FIG. 2 is a perspective view of a container embodying the invention.

Integral with the bottom ends of the side panels, but separated therefrom by the transverse score line 20, are a plurality of panel extensions 46 which are foldable into a flat bottom closure 48 (FIG. 2). This may be completed in any suitable known configuration, as illustrated and described in U.S. Pat. No. 3,120,335, incorporated herein by reference, but forming no part of the present invention.

Referring once again to FIG. 1, it may be noted that an arcuate-shaped notch 50 is formed in the side seam panel 38. A first pair of spaced apart die cuts 52 is formed in the side panel 30, extending laterally in FIG. 1 from the free edge 54 thereof. The cuts 52 are made completely through the paperboard and extend from the edge 54 a distance which is a predetermined amount less than the width of the side seam panel 38, for a purpose to be described. A score line 56 is formed parallel to the edge 54 intermediate the inner ends of the die cuts 52, forming a flexible hinge with the latter when peeled back from the edge 54.

A second pair of spaced apart die cuts 58 are formed across the outside surface of the side seam flap 38, extending laterally in FIG. 1 from the free edge 60 thereof to the score line 28, straddling the notch 50, and aligned laterally with the respective first pair of die cuts 52. The die cuts 58 are formed through the polyethylene coating only. An arcuate die cut 62 is formed in the outside surface of the side panel 36, through the polyethylene coating only, so as to interconnect the inner ends of the die cuts 58.

Figure 3:
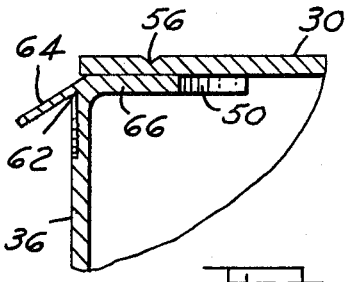
FIGS. 3–5 are fragmentary cross-sectional views illustrating the opening sequence of the inventive straw opening means.
Figure 4:
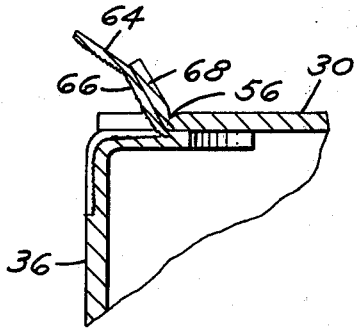
Figure 5:
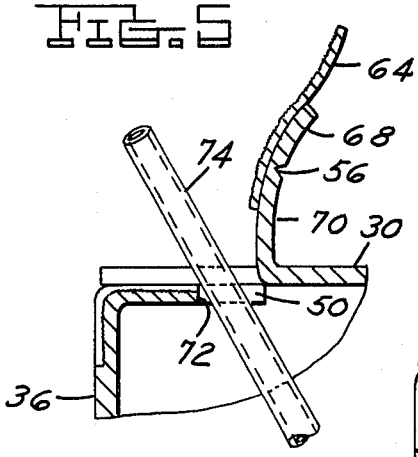

Once the container is formed, as shown in FIG. 2, the arcuate tab 64 formed by the die cut 62 breaks away from the side panel 36 when the latter is bent around the score line 28, as shown in FIG. 3. Thence, the tab 64 facilitates peeling back of the tear strip 66 formed by the die cuts 58. This action lifts the tear strip 68 formed by the die cuts 52, as shown in FIG. 4. Use of the tear strip 68 as a sturdier tab next facilitates peeling back an additional segment 70 (FIG. 5) of the side panel 30, exposing the notch 50 and forming an opening 72 adaptable to having a straw 74 extended therethrough. Hence, the need for a gable top and typical pour spout on a container, such as a milk carton, is eliminated. This is particularly applicable to half-pint and/or small cross-section carton sizes.

It's apparent that, since there is no conventional top pouring spout required, the panel 30, formerly referred to as a side panel, may now serve as a top panel, and the inked printing may be formed on the various panel surfaces accordingly.

Figure 6:
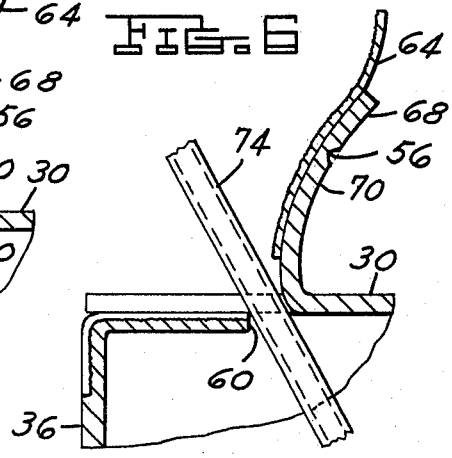
FIG. 6 is a fragmentary cross-sectional view of an alternate embodiment of a portion of the structure of the invention as shown in FIGS. 1–5.

Referring now to the alternate embodiment shown in FIG. 6, it is noted that the notch 50 of FIGS. 1-5 is not included. Hence, the tab 64 and the tear strip 68 facilitate peeling back the additional segment 70 to a point far enough beyond the free edge 60 of the side seam flap 38 to provide an opening through which the straw 74 may be inserted.

INDUSTRIAL APPLICABILITY

It should be apparent that the invention provides a novel, efficient and sanitary means for facilitating the use of a straw with a liquid carrying carton, without having to open the conventional pouring spout thereof. The above described arrangements would be applicable to blanks which are mirror images of the blanks 10.

While but one embodiment of the invention has been shown and described, other modifications thereof are possible.

The embodiments of the invention in which an exclusive property or privilege is claimed are defined as follows:

1. In a liquid carrying plastic coated paperboard container comprising a tubular body formed of first, second, third, fourth and fifth panels, with the first and fifth panels being overlapped and secured to one another to form one wall panel, two oppositely disposed end closures, and straw opening means formed in the one wall panel, the tubular body being adapted to being filled in a vertical attitude through one of the end closures and then, after the sealing of the one of the end closures, rotated onto the third panel, thereby locating the one wall panel and, hence, the straw opening means in the uppermost position of the container when so rotated for the insertion of a straw therethrough, the improvement comprising aligned outer and inner pairs of die cuts formed in the first and fifth overlapped panels, respectively, and extending from the respective free edges thereof, a score line formed on said first panel intermediate the inner ends of the outer pair of die cuts, and an arcuate die cut formed on said fourth panel interconnecting the inner ends of the inner pair of die cuts.

2. The improvement described in claim 1, wherein said inner pair of die cuts extend all the way across said fifth panel, and said outer pair of die cuts are shorter than said inner pair of die cuts, stopping short of the adjacent free edge of said fifth panel.

3. The improvement described in claim 1, wherein said outer pair of die cuts is formed completely through said first panel to form a tear strip terminating at said score line.

4. The improvement described in claim 1, wherein said inner pair of die cuts is formed through the plastic coating only of said fifth panel to form a tear strip terminating at the inner edge of said fifth panel.

5. The improvement described in claim 1, wherein said arcuate die cut is formed through the plastic coating only of said fourth panel, thereby causing the plastic coating within the arcuate shape thereof to break away from said fourth panel when the latter is bent with respect to said fifth panel, and resulting in the formation of a tab of plastic coating extending away from said fourth panel.

6. The improvement described in claim 5, and a notch formed in said fifth panel intermediate said inner pair of die cuts, providing an opening through which a straw may be inserted when said tab and tear strip are peeled back to approximately said inner edge of said fifth panel.

* * * * *